US007036289B2

(12) United States Patent
Suolahti

(10) Patent No.: US 7,036,289 B2
(45) Date of Patent: May 2, 2006

(54) WRAPPING MACHINE AND TOP FOIL WRAPPING MACHINE

(75) Inventor: Yrjo Suolahti, Mynämäki (FI)

(73) Assignee: Oy M. Haloila AB, Masku (FI)

( * ) Notice: Subject to any disclaimer, the term of this patent is extended or adjusted under 35 U.S.C. 154(b) by 0 days.

(21) Appl. No.: 10/786,162

(22) Filed: Feb. 26, 2004

(65) Prior Publication Data

US 2004/0226266 A1 Nov. 18, 2004

(30) Foreign Application Priority Data

Feb. 27, 2003 (FI) ..... 20030305

(51) Int. Cl.
*B65B 59/04* (2006.01)

(52) U.S. Cl. ..... 53/201; 53/556; 53/587; 53/210; 53/393

(58) Field of Classification Search ..... 53/201, 53/587, 556, 210, 393, 504
See application file for complete search history.

(56) References Cited

U.S. PATENT DOCUMENTS

| | | | | |
|---|---|---|---|---|
| 2,348,043 | A * | 5/1944 | Webb et al. | 248/669 |
| 4,204,377 | A | 5/1980 | Lancaster et al. | |
| 4,993,209 | A | 2/1991 | Haloila | |
| 5,423,163 | A | 6/1995 | Wendt | |
| 5,636,496 | A * | 6/1997 | Pietila et al. | 53/399 |
| 6,170,233 | B1 * | 1/2001 | Marois et al. | 53/399 |
| 6,360,512 | B1 | 3/2002 | Marois et al. | |
| 2003/0101687 | A1 * | 6/2003 | Zitella et al. | |

FOREIGN PATENT DOCUMENTS

| | | |
|---|---|---|
| DE | 196 03 487 A | 8/1996 |
| EP | 0 811 554 A1 | 12/1997 |
| EP | 1 327 584 A1 | 7/2003 |

* cited by examiner

*Primary Examiner*—Stephen F. Gerrity
*Assistant Examiner*—Hemant M. Desai
(74) *Attorney, Agent, or Firm*—Lowe Hauptman & Berner, LLP

(57) ABSTRACT

A wrapping machine and/or a top foil wrapping machine machine frame, which is supported on a fixed base and has upright vertical columns and horizontal cross members connecting the vertical columns to each other. Each vertical column has at least two column parts detachably joined together end on end, the column parts including a lower column part and an upper column part. Only the lower column parts of the vertical columns are connected to each other by the cross members while the upper column parts are not connected to each other. To store and/or transport the machine, the machine is reduced to a low size (A) for packaging, by detaching the upper column parts from the lower column parts of the vertical columns. The upper column parts may be reattached to the lower column parts to install the machine from the packaged size (A) to a full working size (B).

9 Claims, 4 Drawing Sheets

WRAPPING MACHINE AND TOP FOIL WRAPPING MACHINE

FIELD OF THE INVENTION

The present invention relates to a wrapping machine, and more particularly, to a top foil wrapping machine.

BACKGROUND OF THE INVENTION

In prior art, a wrapping machine used to wrap a plastic foil web around an object to be wrapped is known. Similarly, a top foil wrapping machine used to set a desired length of top foil onto an object to be wrapped is known.

The object to be wrapped is usually a load placed on a pallet, which typically is an assembly of the form of a rectangular parallelepiped. A feature common to the wrapping machine and the top foil wrapping machine is that they comprise a machine frame supported on a fixed floor base. The frame usually comprises four upright vertical columns. The upper ends of the vertical columns are connected to each other by cross members forming a so-called top frame, while their lower ends are similarly connected together by cross members. Both machines further comprise a lifting frame arranged to be vertically movable upwards and downwards, being guided by the vertical columns. Both machines further comprise a lifting motor for moving the lifting frame, and power transmission means for the transmission of power from the lifting motor to produce vertical motion of the lifting frame.

The wrapping machine comprises a foil dispenser, on which a foil web roll can be rotatably supported. Supported by the lifting frame is a wrapping frame, which typically forms a circular endless path for the foil dispenser. The foil dispenser circulates along the path defined by the wrapping frame around the object to be packaged, allowing the plastic foil web to be unrolled from the foil web roll to form a wrapping around the object to be packaged.

The top foil wrapping machine has a top foil depositor supported on or connected to the lifting frame and arranged to deposit a top foil from the top foil web roll onto the object to be wrapped.

A prior-art wrapping machine and/or top foil wrapping machine has a top frame because, among other things, it forms a mounting base for the lifting motor and for the bearings of the diverting and tensioning pulleys used in the lifting frame drive arrangement in conjunction with the power transmission chains as well as for the bearings of the drive shafts.

A problem with the prior-art wrapping machine and/or top foil wrapping machine is that it has to be transported from the place of manufacture to the place of use for the client in full size, in other words, with a height dimension that the machine will have when used at the place of application. To reduce the packaged size of the machine for transportation, disassembly of the prior-art machine is out of the question because assembling it requires a great deal of work, time, expertise and the use of special tools, while the functionality of the machine can not be guaranteed if there is no skilled personnel and special tools available for the assembly work. As numerous parts are located at a level high up from the floor, work safety is also poor because the person performing the installation has to work standing on ladders and similar levels elevated from the floor level. On the other hand, transportation of a full-size machine involves high freight costs, impairing profitability.

SUMMARY OF THE INVENTION

The object of the present invention is to overcome the above-mentioned draw-backs.

A specific object of the invention is to disclose a wrapping machine and/or top foil wrapping machine that, for transportation and storage, has a packaged size smaller than that of earlier machines and for which the freight costs are small.

A further object of the invention is to disclose a wrapping machine and/or top foil wrapping machine that can be easily and quickly put into working order at the place of use without requiring the person doing the work to have special tools or special skills.

An additional object of the invention is to disclose a wrapping machine and/or top foil wrapping machine that can be put into working order in conditions of good work safety.

According to the invention, each vertical column comprises at least two column parts detachably joined together end on end, said column parts comprising a lower column part and an upper column part. Only the lower column parts of the vertical columns are connected to each other by cross members while the upper column parts are separate from each other. The vertical column may consist of two or more column parts.

The invention provides the advantage that the machine can be reduced to a small size for packaging, thus allowing the machine to be transported in a compact form at low freight costs. The total height of the vertical columns can be adjusted by selecting a desired length for the upper column parts. By simple and fast operations, the machine can be easily converted from packaged size to working order by personnel working at the floor level under safe working conditions. For final assembly at the place of use, no special tools or specially trained labor is needed.

In an embodiment of the wrapping machine and/or top foil wrapping machine, the wrapping machine comprises splice joint elements for joining the lower column parts and the upper column parts together.

In an embodiment of the wrapping machine and/or top foil wrapping machine, the lower column part and the upper column part are box section beams of identical cross-section having a hollow space inside them. The splice joint element is a profiled beam whose external shape substantially corresponds to the shape of this hollow space.

In an embodiment of the wrapping machine and/or top foil wrapping machine, the lower column part comprises a supporting element designed to support a lifting frame to be lowered onto it.

In an embodiment of the wrapping machine and/or top foil wrapping machine, a lifting motor is secured to the lifting frame so as to be movable with it.

In an embodiment of the wrapping machine and/or top foil wrapping machine, the machine comprises elongate flexible drive elements and wheels driven by the lifting motor for the transmission of power from the lifting motor to produce a vertical motion of the lifting frame.

In an embodiment of the wrapping machine and/or top foil wrapping machine, the wheels comprise a drive belt pulley fitted for reeling a flat belt, said drive belt pulley being rotatably mounted by means of a bearing on the lifting frame and rotated by the lifting motor and that each one of the elongate drive elements consists of a belt whose first end is secured to the upper end of a vertical column while the second end is secured to the drive belt pulley.

In an embodiment of the wrapping machine and/or top foil wrapping machine, the lifting frame comprises two parallel elongate lateral frame parts, each extending horizontally between two vertical columns. The drive belt pulley is mounted in a position aligned with a lateral frame part. A diverting pulley is provided at each end of the two lateral frame parts, the drive belt coming from the drive belt pulley being passed over the respective diverting pulley to the upper end of the vertical column.

In an embodiment of the wrapping machine and/or top foil wrapping machine, the power transmission means comprise a drive shaft to which the lifting motor is coupled to rotate it, with a drive belt pulley mounted at each end of the drive shaft.

BRIEF DESCRIPTION OF THE DRAWINGS

In the following, the invention will be described in detail by the aid of examples with reference to the attached drawing, wherein.

DETAILED DESCRIPTION OF THE EMBODIMENTS

Figure 1:
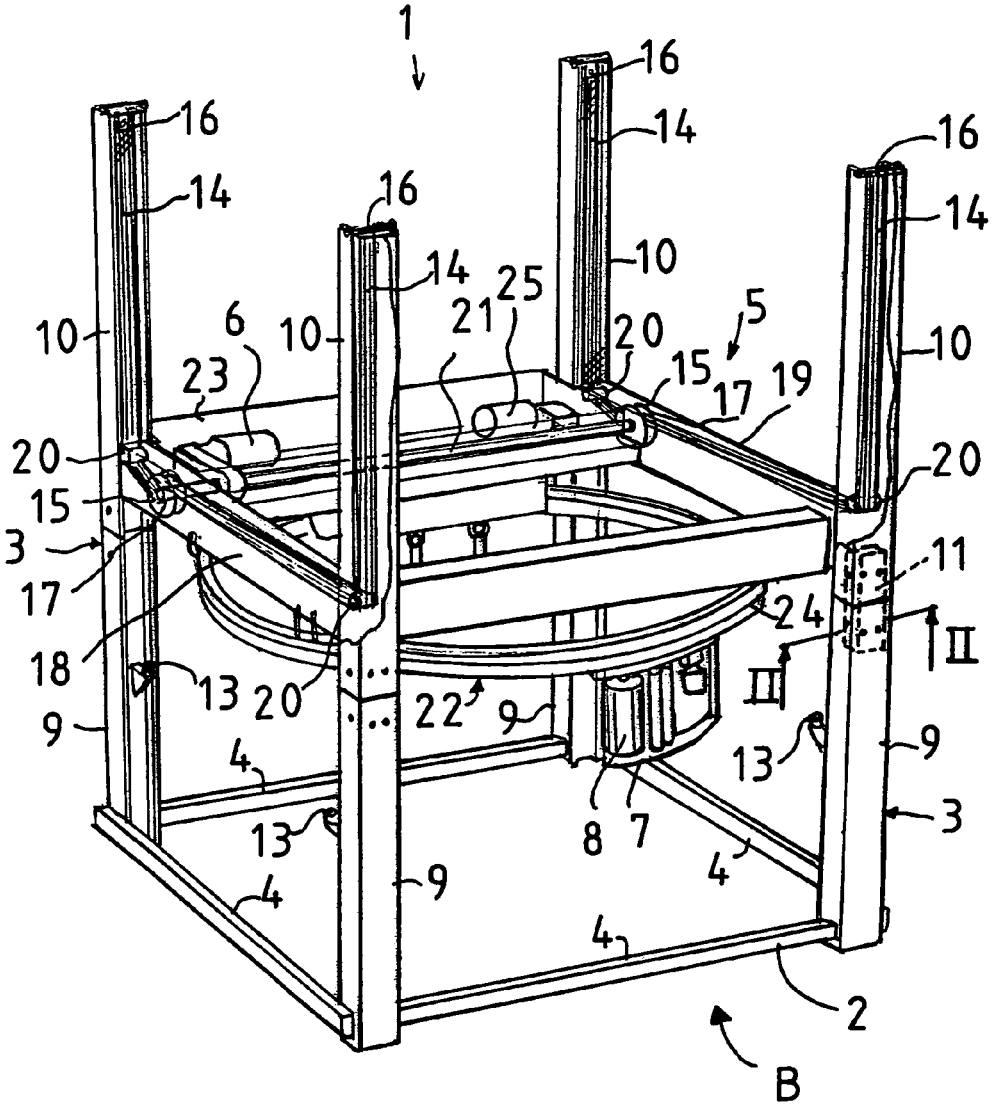
FIG. 1 presents an axonometric oblique top view of an embodiment of the wrapping machine of the invention.

FIG. 1 presents a wrapping machine 1 for wrapping a plastic foil web around an object (not shown) to be packaged. The wrapping machine 1 comprises a machine frame 2 supported on a fixed floor base. The machine frame 2 comprises four upright vertical columns 3 arranged at a distance from each other in a rectangular configuration such that a vertical column 3 is placed at each corner of the imaginary rectangular configuration. A lifting frame 5 has been arranged to be vertically movable along the vertical columns 3 by means of a lifting motor 6. From the lifting motor 6, power is transmitted by power transmission means to produce a vertical motion of the lifting frame 5. The power transmission means comprise flexible flat belts 14 and pulleys 15 for transmitting the power of the lifting motor 6 to the flat belts 14.

A foil dispenser 7, on which a foil web roll can be rotatably supported, has been arranged to circulate as guided by a circular ring arrangement 22 along a circular path around the object to be packaged, allowing the plastic foil web to be unrolled from the foil web roll 8 to form a wrapping around the object to be packaged. As the circular ring arrangement supporting the foil dispenser is simultaneously moved in a vertical direction by moving the lifting frame, a spiral wrapping is produced around the object to be wrapped.

Each vertical column 3 comprises two column parts 9, 10 detachably butted together, said column parts comprising a lower column part 9 and an upper column part 10. Only the lower column parts 9 of the vertical columns 3 are connected to each other by cross members 4 while the upper column parts 10 stand freely without being interconnected. They are only joined together via the lower column parts 9.

Figure 2:
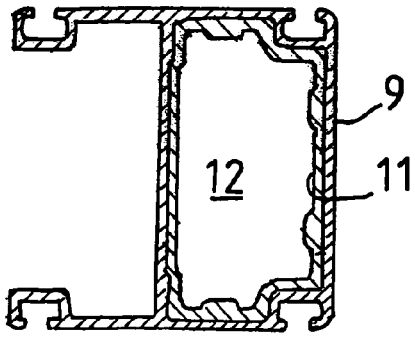
FIG. 2 presents a sectional view along line 11—11 in FIG. 1.

As can be seen from FIGS. 1 and 2, the lower column part 9 and the upper column part 10 are secured to each other by means of splice joint elements 11. In cross-section, the lower column part 9 and the upper column part 10 are identical box section beams having a hollow space 12 inside. In this example, the splice joint element 11 is a profiled beam whose external shape substantially corresponds to the shape of the hollow space so that it fits inside the column parts with a small clearance and can be secured to them by bolt joints.

Figure 3:
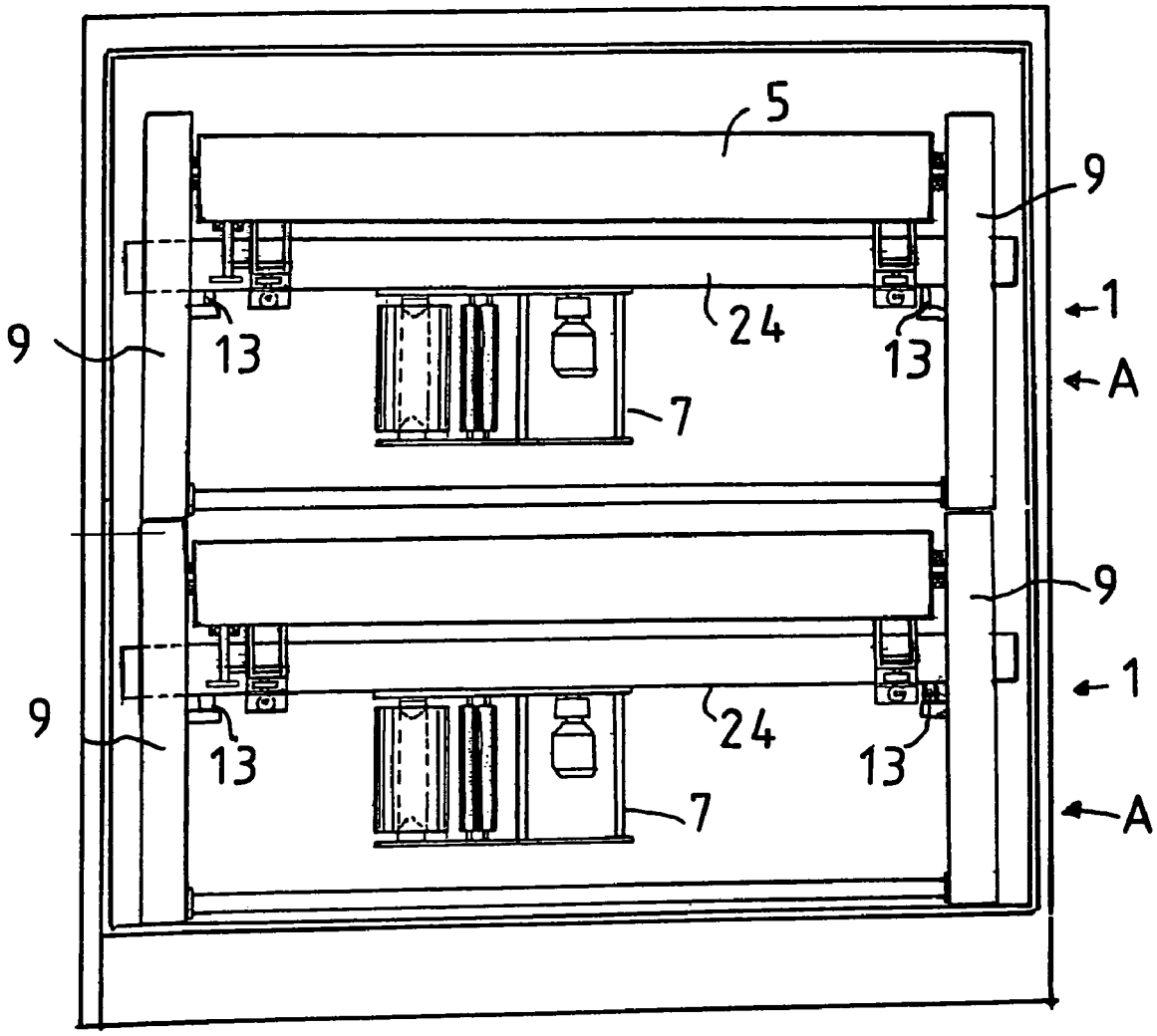
FIG. 3 presents a diagrammatic view of two wrapping machines according to FIG. 1 in a low packaged size and stacked one upon the other in a freight container.

As is shown in FIGS. 1 and 3, the lower column part 9 comprises a supporting element 13, which can support the lifting frame 5 lowered onto it when the wrapping machine 1 is in the packaged size A illustrated in FIG. 3.

It is to be noted that the circulating movement of the foil dispenser 7 along a ring-like path can be achieved by other known arrangements as well, such as an arrangement in which the foil dispenser is connected to a rotating crank that circulates the foil dispenser 7 about the object to be wrapped.

The lifting motor 6 is secured to the lifting frame 5 and it therefore moves with the lifting frame. A drive belt pulley 15 for reeling the flat belts 14 is provided. The drive belt pulley 15 is rotatably mounted by means of a bearing on the lifting frame 5 and connected to the shaft of the lifting motor 6. The first ends 16 of the flat belts 14 are secured to the upper ends of the vertical columns 3 while their second ends 17 are secured to the drive belt pulley 15.

The lifting frame 5 has the shape of a substantially rectangular frame and it is disposed in a horizontal position within the area defined by the vertical columns 3.

Figure 4:
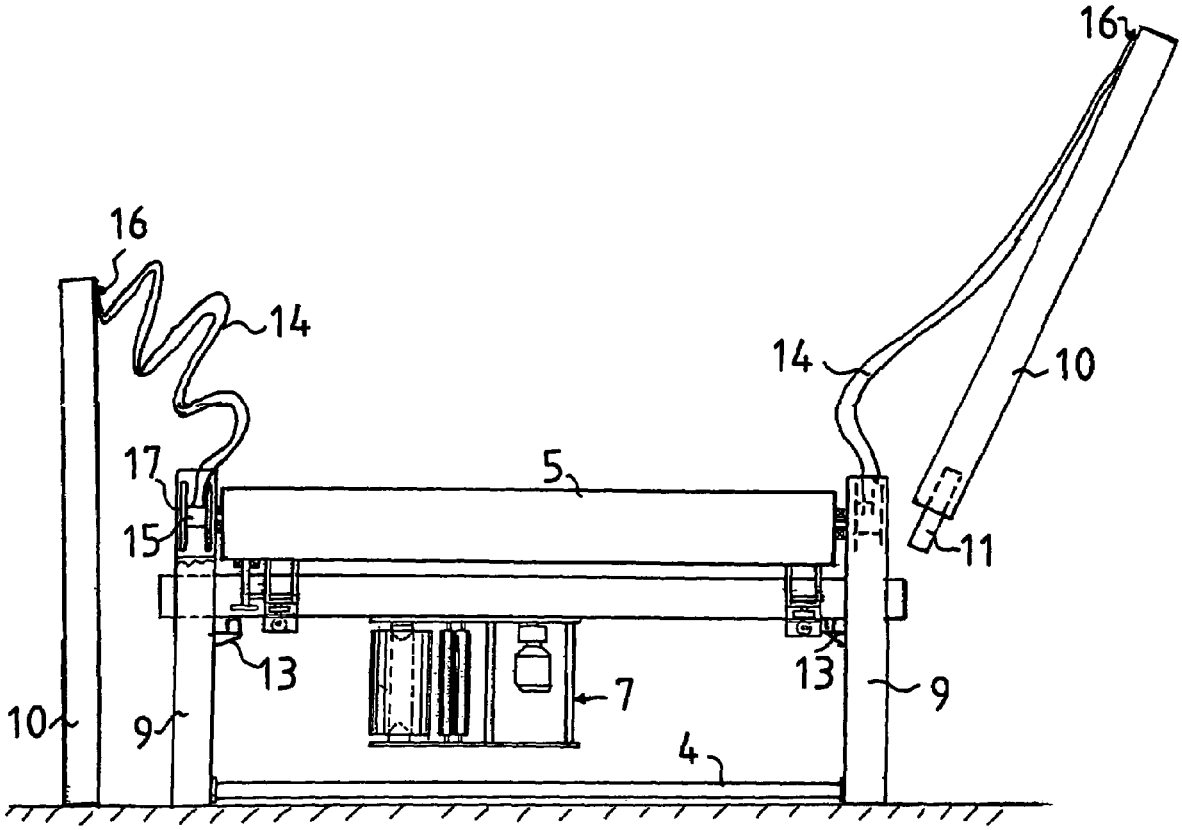
FIG. 4 is a diagrammatic representation of the process of converting the wrapping machine from packaged size into working size.

As can be best seen from FIGS. 1, 3 and 4, the lifting frame 5 is provided with an equipment box 23 inside which the lifting motor 6 is disposed. The lifting frame 5 comprises two elongate box-like lateral frame parts 18, 19 parallel to each other, each extending horizontally between two vertical columns 3. The drive belt pulley 15 is mounted inside the box of a lateral frame part. As shown in FIG. 1, at each end of the two lateral frame parts 18 19 there is a diverting pulley 20, which diverts the belt 14 extending substantially horizontally from the drive belt pulley 15 so as to make it run vertically to the upper end of the vertical column 3.

The power transmission means further comprise a drive shaft 21 rotated by the lifting motor 6, which is connected to it via a reduction gear. Mounted on each end of the drive shaft 21 is a drive belt pulley 15.

Disposed below the lifting frame 5 is a circular ring arrangement 22 forming the path of movement of the foil dispenser 7. The circular ring arrangement 22 is suspended on the lifting frame 5 so as to be vertically movable with it. The circular ring arrangement 22 comprises a circular ring-like rotary frame 24 suspended in a horizontal position on the lifting frame 5 and rotatably mounted so that it can rotate about its center. The foil dispenser 7 is secured to the rotary frame 24 so that it circulates with the rotary frame. To rotate the rotary frame 24, a rotating motor 25 is provided. The rotating motor 25 is placed in the space inside the equipment box 23.

In the method—referring to FIGS. 1, 3 and 4—the wrapping machine 1 is reduced to a low packaged size A as shown in FIG. 3 for transportation or storage by detaching the upper column parts 10 of the vertical columns 3 from the lower column parts 9. The wrapping machine 1 is transported and/or stored in the low packaged size A, which makes it possible to transport wrapping machines e.g. in a freight container by stacking two machines one upon the other. At the place of manufacture, the belts 14 are reeled up on the drive belt pulleys 15.

FIG. 4 visualizes that, at the place of use, the upper column parts 10 are fixed to the lower column parts 9 to install the wrapping machine 1 from the packaged size A into the full working size B. At the place of use, the wrapping machine 1 is installed in full working size B by unrolling a required length of the belts 14 from the drive belt pulleys 15 and securing the free end 16 of each belt 14 to the upper end of each second column part 10, securing each upper column part 10 to the corresponding lower column part 9 by means of a splice joint element 11 and rotating the drive belt pulleys 15 by means of the lifting motor 6 to reel the belts 14 onto the drive belt pulleys 15 so as to raise the lifting frame 5 from the supporting elements 13.

Figure 5:
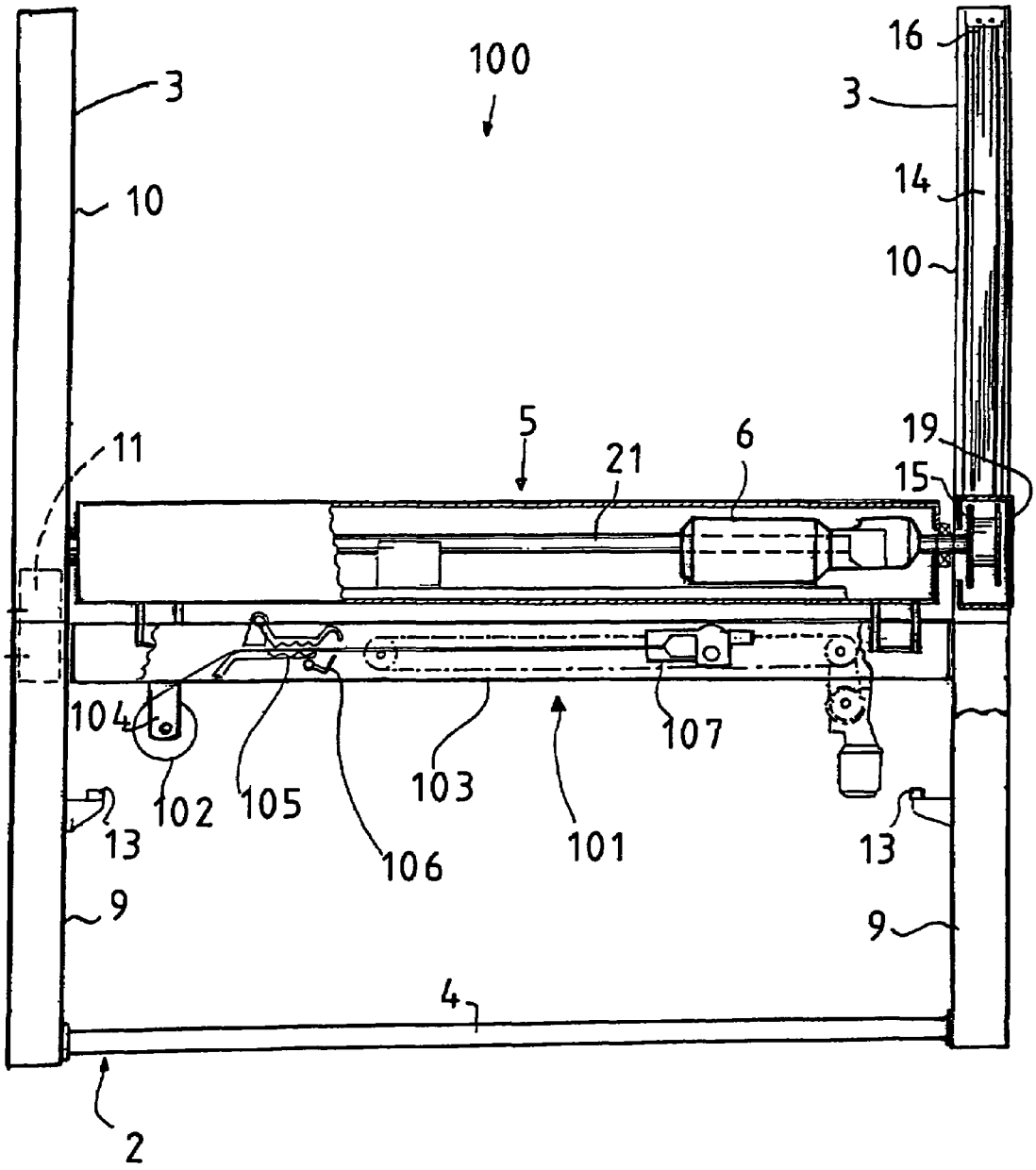
FIG. 5 presents a diagrammatic side view of an embodiment of the top foil wrapping machine of the invention.

FIG. 5 presents a top foil wrapping machine 100, which is capable of setting a top foil over the object (not shown) to be packaged.

In respect of the machine frame 2, the vertical columns 3 divided into two parts, a lower column part 9 and an upper column part 10, the joining of these, the lifting frame 5 and its belt drive arrangement, the top foil wrapping machine 100 has a construction corresponding to the wrapping machine 1 in FIGS. 1–4. Therefore, for a description of these parts, reference is made to the above description of FIGS. 1–4. Likewise, transportation and/or storage of the top foil wrapping machine 100 and the task of setting it up in working order at the place of use are accomplished as described above with reference to FIGS. 1, 3 and 4. In FIG. 5, the top foil wrapping machine 100 has a depositor 101, whose depositor frame 103 is placed below and secured to the lifting frame 5. The depositor frame 103 comprises supporting elements 104 for rotatably sup-porting a top foil web roll 102 on the depositor frame. Further, mounted on the depositor frame 103 is a holding device 105, which is provided with gripping jaws movable towards each other from above and below the web. The holding device 105 is designed to hold the top foil web when it is to be severed by a cut-ting device 106 placed near the holding device. The holding device 105 holds the end of the web until a horizontally movable gripping element 107 grips the end of the top foil web, whereupon the holding device 105 releases the web and the gripping element 107 can draw the web in its grip over the object to be packaged. The culling device 106 then cuts the top foil web drawn over the object and the gripping element 107 at the other end releases the web from its grip, a length of top foil being thus severed and deposited over the object.

The invention is not limited to the embodiment examples described above; instead, many variations are possible within the scope of the inventive concept defined in the claims.

The invention claimed is:

1. A wrapping machine for wrapping a web around an object to be packaged, said wrapping machine comprising:

a machine frame supportable on a fixed base and comprising a plurality of columns and cross members connecting the columns to each other;

a lifting motor;

a lifting frame arranged to be movable upwards and downwards along the columns by means of said lifting motor;

a foil dispenser for rotatably supporting a roll of the web, said foil dispenser being movable with the lifting frame and arranged to circulate along a circular path around the object to be packaged to unroll the web from the roll so as to form a wrapping around the object to be packaged; and at least an elongate flexible drive element and a wheel driven by the lifting motor for transmitting power from the lifting motor to produce a motion of the lifting frame along the columns;

wherein each of said columns comprises a lower column part and an upper column part detachably joined together;

the wheel comprises a drive belt pulley rotatably mounted on the lifting frame and rotatable by the lifting motor; and the elongate drive element comprises a belt having a first end secured to an upper end of one of the columns and a second end secured to the drive belt pulley.

2. The wrapping machine according to claim 1, wherein the lifting frame comprises a diverting pulley, the belt coming from the drive belt pulley being passed over the diverting pulley to the upper end of the vertical column to which the second end of said belt is secured.

3. The wrapping machine according to claim 1, further comprising a drive shaft coupled to and driven by the lifting motor, the drive belt pulley being mounted at an end of said drive shaft.

4. A top foil wrapping machine for depositing a web over an object to be packaged, said top foil wrapping machine comprising:

a machine frame supportable on a fixed base and comprising a plurality of columns and cross-members connecting the columns to each other;

a lifting motor;

a lifting frame arranged to be movable upwards and downwards along the columns by means of said lifting motor;

a top foil depositor connected to the lifting frame and arranged to deposit the web from a roll of the web over the object to be packaged; and at least an elongate flexible drive element and a wheel driven by the lifting motor for transmitting power from the lifting motor to produce a motion of the lifting frame along the columns;

wherein each of said columns comprises a lower column part and an upper column part detachably joined together;

the wheel comprises a drive belt pulley rotatably mounted on the lifting frame and rotatable by the lifting motor; and the elongate drive element comprises a belt having a first end secured to an upper end of one of the columns and a second end secured to the drive belt pulley.

5. The top foil wrapping machine according to claim 4, wherein the lifting frame comprises a diverting pulley, the belt coming from the drive belt pulley being passed over the diverting pulley to the upper end of the vertical column to which the second end of said belt is secured.

6. The top foil wrapping machine according to claim 4, further comprising a drive shaft coupled to and driven by the lifting motor, the drive belt pulley being mounted at an end of said drive shaft.

7. A wrapping machine for wrapping a web around an object to be packaged, said wrapping machine comprising:

a machine frame supportable on a fixed base and comprising a plurality of columns and cross members connecting the columns to each other;

a lifting motor;

a lifting frame arranged to be movable upwards and downwards along the columns by means of said lifting motor; and a foil dispenser for rotatably supporting a roll of the web, said foil dispenser being movable with the lifting frame and arranged to circulate along a circular path around the object to be packaged to unroll the web from the roll so as to form a wrapping around the object to be packaged;

wherein each of said columns comprises a lower column part and an upper column part detachably joined together; and the lower column part comprises a supporting element supporting the lifting frame when the lifting frame is lowered onto said supporting element;

said wrapping machine having a packaged configuration in which the upper column parts are detached from the respective lower columns parts, and the lifting frame rests on the supporting elements of the lower column parts so as to be completely located below exposed upper ends of the lower column parts.

8. A wrapping machine for wrapping a web around an object to be packaged, said wrapping machine comprising:

a machine frame supportable on a fixed base and comprising a plurality of columns and cross members connecting the columns to each other;

a lifting motor;

a lifting frame arranged to be movable upwards and downwards along the columns by means of said lifting motor; and a foil dispenser for rotatably supporting a roll of the web, said foil dispenser being movable with the lifting frame and arranged to circulate along a circular path around the object to be packaged to unroll the web from the roll so as to form a wrapping around the object to be packaged;

wherein each of said columns comprises a lower column part and an upper column part detachably joined together; and only the lower column parts are connected to each other by the cross members, whereas the upper column parts are not directly connected by any of the cross members.

9. A wrapping machine for wrapping a web around an object to be packaged, said wrapping machine comprising:

a machine frame supportable on a fixed base and comprising a plurality of columns and cross members connecting the columns to each other;

a lifting motor;

a lifting frame arranged to be movable upwards and downwards along the columns by means of said lifting motor; and a foil dispenser for rotatably supporting a roll of the web, said foil dispenser being movable with the lifting frame and arranged to circulate along a circular path around the object to be packaged to unroll the web from the roll so as to form a wrapping around the object to be packaged;

wherein each of said columns comprises a lower column part and an upper column part detachably joined together;

said wrapping machine further comprises splice joint elements for joining the respective lower and upper column parts together; and an upper end of each of the lower column parts is hollow for receiving therein one of the splice joint elements with the upper end of the lower column part completely surrounds said splice joint element.

* * * * *